US008161896B1

(12) United States Patent
Ingram et al.

(10) Patent No.: US 8,161,896 B1
(45) Date of Patent: Apr. 24, 2012

(54) HOLLOW NEEDLE CUTTING APPARATUS

(75) Inventors: Gary L. Ingram, Ooltewah, TN (US); Steven L. Frost, Signal Mountain, TN (US)

(73) Assignee: Tuftco Corporation, Chattanooga, TN (US)

( * ) Notice: Subject to any disclaimer, the term of this patent is extended or adjusted under 35 U.S.C. 154(b) by 437 days.

(21) Appl. No.: 12/506,971

(22) Filed: Jul. 21, 2009

Related U.S. Application Data

(60) Provisional application No. 61/082,305, filed on Jul. 21, 2008.

(51) Int. Cl.
*D05C 11/20* (2006.01)
*D05C 15/24* (2006.01)

(52) U.S. Cl. ..... 112/80.05; 112/80.08; 112/80.7

(58) Field of Classification Search .... 112/80.05–80.16, 112/80.55–80.7; 83/910, 935
See application file for complete search history.

(56) References Cited

U.S. PATENT DOCUMENTS

| | | | | |
|---|---|---|---|---|
| 3,142,276 | A * | 7/1964 | Schauer | 112/80.04 |
| 4,991,523 | A * | 2/1991 | Ingram | 112/80.05 |
| 5,165,352 | A * | 11/1992 | Ingram | 112/80.08 |
| 5,588,383 | A | 12/1996 | Davis | |
| 5,829,372 | A * | 11/1998 | Aubourg et al. | 112/80.16 |
| 6,293,211 | B1 | 9/2001 | Samilo | |
| 7,318,383 | B1 * | 1/2008 | Ingram et al. | 112/80.4 |

* cited by examiner

*Primary Examiner* — Ismael Izaguirre
(74) *Attorney, Agent, or Firm* — Miller & Martin PLLC

(57) ABSTRACT

A hollow needle tufting apparatus is provided with swivel mounted knives and an improved needle design directed to improve cutting efficiency and the life of the hollow needles and associated knives.

20 Claims, 6 Drawing Sheets

HOLLOW NEEDLE CUTTING APPARATUS

The present application claims priority to the Jul. 21, 2008 filing date of U.S. provisional patent application Ser. No. 61/082,305.

FIELD OF THE INVENTION

The present invention relates to an improved cutting apparatus utilized in connection with tufting with hollow needles to which a plurality of yarns are selectively fed.

BACKGROUND OF THE INVENTION

In hollow needle tufting machines, as typified by Kile, U.S. Pat. No. 4,549,496 and Davis et al., U.S. Pat. No. 5,588,383, it is important that the knives be precisely aligned with the angular cutting faces of the hollow needles. In prior art tufting machines with hollow needles spaced on two inch centers, a typical two meter tufting machine might have 75 needles. The alignment between the knives and needles in these machines is generally achieved in two steps. First, the knives and needles are mounted as precisely as possible so that the knife blades will be parallel to the angular surfaces of the hollowed needles. Then the tufting machines are operated and because of pressure placed by the knives against the angular cutting surfaces, the knives and needles wear sufficiently to achieve an acceptable alignment.

Historically, the mounting of the hollow needles was itself a time consuming process. Now it has become possible to mount hollow needles more closely to the desired alignment, as in the fashion described in Ingram, U.S. Pat. No. 7,318,383. Therefore, it is desirable to achieve that precise alignment between knife and hollow needle angular cutting surface more easily and without the necessity of operating a tufting machine to achieve the wear-in that has previously provided the final alignment between these parts. In addition, it is desirable to extend the life of the knives and needles and to provide a structure that can be utilized with both fixed knives and knives that are selectively operable to cut only selective yarns. In order to accomplish these and other objectives of the invention, an improved hollow needle is provided with a recess at the rear end of the angular cutting surface. In addition, knives may be mounted to swivel to enable the knives to change their orientation with respect to the hollow needles slightly and thereby achieve the necessarily precise cutting alignment. A knife mount is also provided that may be either locked in a fixed position, or allowed to shift vertically in response to a vertical actuator such as a pneumatic cylinder so that both cut and cut/loop configurations of the tufting machine are possible without the need of a substantial inventory of varying parts.

BRIEF DESCRIPTION OF THE DRAWINGS

The particular features and advantages of the invention as well as other objects will become apparent from the following description taken in connection with the accompanying drawings in which.

DETAILED DESCRIPTION OF THE INVENTION

Figure 1:
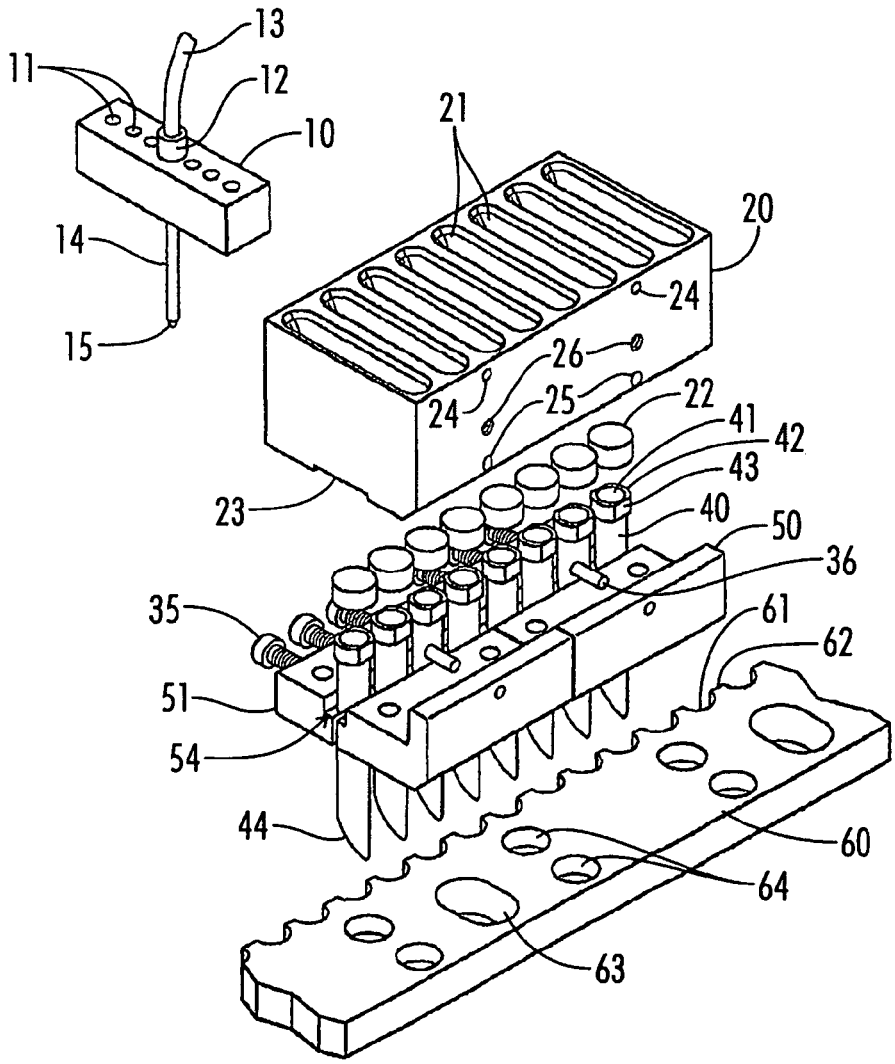
FIG. 1 (PRIOR ART)
FIG. 1 is an exploded view of an embodiment of a prior art narrow gauge hollow needle tufting assembly.

Turning first to FIG. 1, a cover plate 10 is shown with a yarn feed openings 11 proceeding in a longitudinal row. While the illustrated cover plate has six yarn feed openings, alternative plate designs could easily be created with between about four and eight yarn feed openings 11. Through a central opening in cover plate 10 is collar 12 which receives an air supply line 13 at its upper end and it connects to tube 14 at its lower end, enabling the tube 14 to guide air downward to its outlet 15. Cover plate 10 fits over a longitudinal tapered slot 21 in funnel block 20. It will be appreciated that cover plate 10, rather than being designed a cover a single slot 21 could be made wider with a plurality of longitudinal rows of yarn feed openings to cover a plurality of slots. In operation, yarns extend downward through openings 11 of the cover plate 10 into a slot 21 of funnel block 20. Downward directed air pressure through openings 11 and gravity keep the yarns downwardly entrained within slot 21 and the jet of air proceeding from outlet 15 is designed to rapidly encourage a selective yarn downward and into the annular opening 41 of hollow tufting needle 40 positioned beneath a selected tapered slot 21. The funnel block 20 also has a bottom channel 23 which allows some downwardly directed air flow to escape laterally rather than proceeding through the hollow needles 40. Funnel block 20 also has lower pin holes 25 for mounting, as with pins 36, to front needle holder blocks 50, in addition to central threaded openings 26 and upper pinholes 24 for fastening purposes. At the bottom of slot 21, cylindrical inserts 22 are inset and the funnel block 20 is mounted over hollow needle heads 42 so that the openings at the bottom tapered slots 21 ending in cylindrical inserts 22 are directly positioned over the openings 41 of hollow needles 40. The heads of hollow needles 40 have at least one planar side 43, and in the illustrated embodiments have a pair of parallel opposed planar sides to facilitate alignment. Specifically, rear needle holder blocks 51 and front needle holder blocks 50 are joined by threaded allen bolts 35 in a fashion that leaves a channel 54 extending laterally across their joined upper surface. The channel 54 is defined by opposed planar sides. The opposed planar surfaces 43 of the heads 42 of hollow needles 40 align with the planar sides of the channel 54 to require the hollow needles 40 to be positioned so that the angled cutting surface 44 of needles 40 is precisely aligned in a rearward facing direction. With the two opposed planar surfaces 43 it will be seen that the hollow needles 40 may be aligned with the cutting surface 44 facing either directly forward or directly rearward, however, the rearward direction is selected so that the cutting surface 44 can properly interface with knives 47, as shown in FIG. 2.

In operation, backing fabric for tufting is fed over backing support bar 60. The preferred backing support bars have a series of merlons 62 which are aligned to extend rearward between hollow needles 40 to about the mid point of those needles. Thus, the height of merlons 62 with respect to the interspaced accurate hollows or crenels 61 is about equal to the radius of the hollow needles 40. The merlons 62 support the backing fabric against the downward pressure applied when angled surfaces 44 penetrate the backing fabric to insert stitches of yarn.

Figure 2:
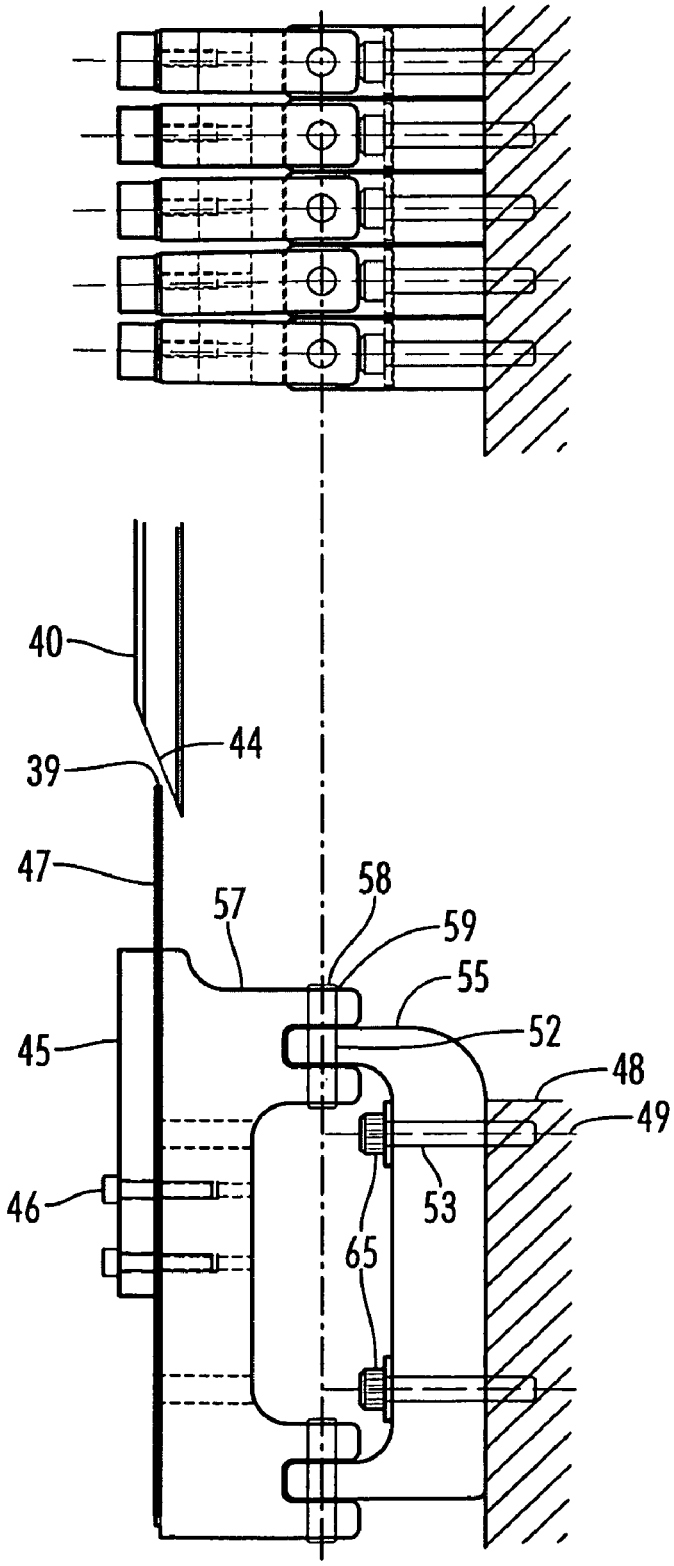
FIG. 2 is a side plan view of a swivel mounted knife assembly of the present invention used for creating cut pile yarn tufts.

The backing support bar 60 has openings 64 and slots 63 for mounting above a knife bar 48, shown in FIG. 2, which holds a plurality of laterally spaced knives 47. In the illustrated embodiment, knife bar 48 has openings 49 to receive mounting pins 65 which pass through openings 53 in mounting bracket 55. At the top and bottom of mounting bracket 55 are openings 52 in rearward extending arms that receive swivel pins 58 passing through openings 59 in forward extending arms of swivel brackets 57. Swivel brackets 57 receive mounting pins 46 passing through openings in clamping blocks 45 and knives 47 thereby securing the knives to the swivel brackets 57. It can be seem that swivel brackets 57 may pivot or rotate about swivel pins 58 with respect to their associated mounting brackets 55 and the knife bar 48. In this fashion, the width of each knife edge 39 can be precisely aligned to a position parallel across the angled cutting surface 44 of each hollow needle 40 with relatively little force.

Figure 3A:
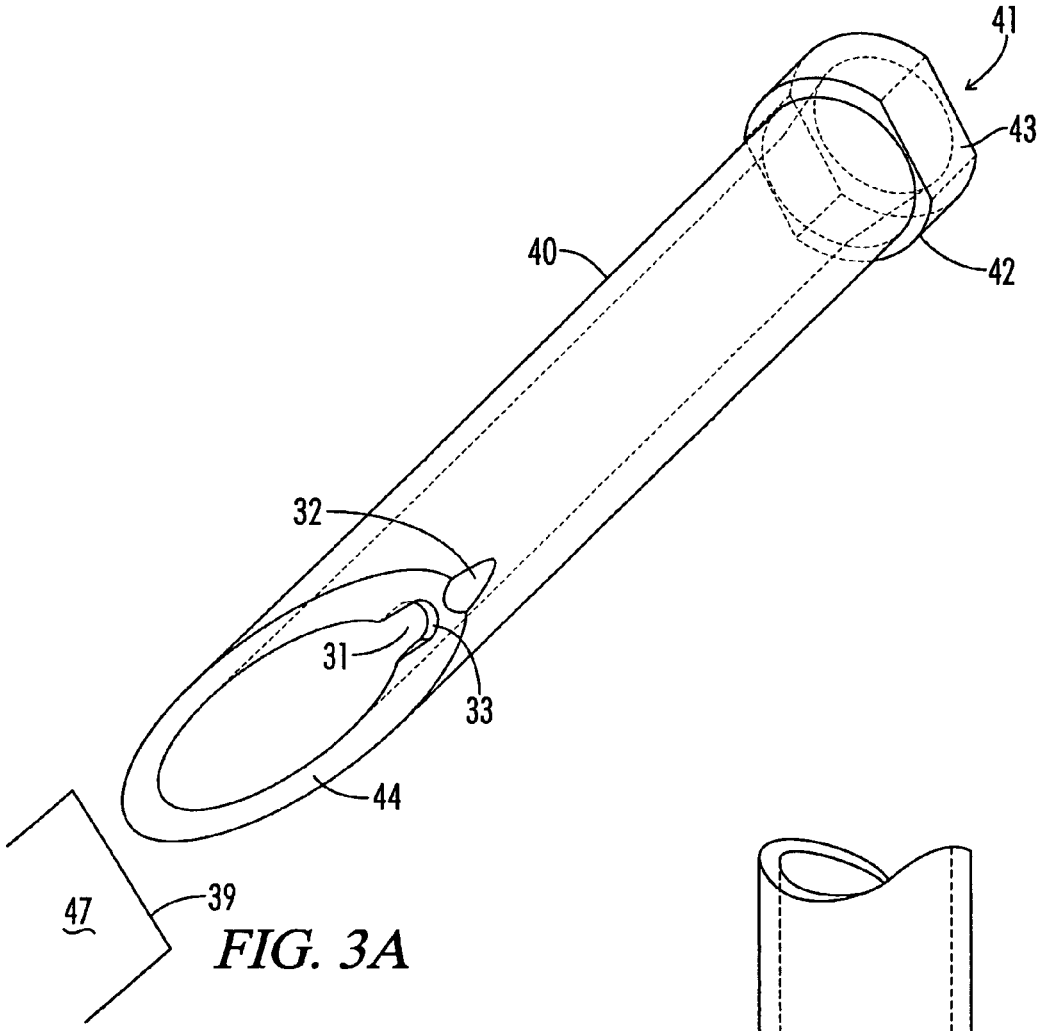
FIG. 3A is an enlarged isometric view of an improved hollow tufting needle according to the present invention shown in proximity to the knife edge of an associated knife.

FIG. 3A provides a perspective view of an improved hollow needle 40 according to the invention. Hollow needle 40 is shown with head 42 having a planar surface 43 and an angular opening 41 extending therethrough. At the opposite end of needle 40 is the angular cutting surface 44 beginning at distal end 38 and extending rearward to notch 31. The slant of the cutting surface generally creates an ovular opening, however, this opening is modified by the creation of notch 31 into which yarn is directed for cutting. Notch 31 has cutting edge 33 which preferably interfaces with knife edge 39 to sever yarn that has been urged down through the angular opening 41 of hollow needle 40 and into notch 31. A modification on this needle is the placement of hollow 32 just above the notch 31 so that a smaller area of the angled cutting surface 44 is present adjacent to the notch 31 and cutting edge 33. In this fashion, as the knife edge 39 passes across the angled cutting surface 44, slightly less wear is imparted to the center of the knife edge 39. Because the exact operation of the cutting mechanism varies according to operator preference, with some operators beginning contact between the knife edge 39 and angular cutting surface 44 not merely near the midpoint of the cutting surface 44 but very near the forward end of the ovular opening opposite the notch 31, and some operators continuing the movement of the knife edge 39 not merely until crossing cutting edge 33 but across the entire angled cutting surface 44, the hollow 32 helps provide more uniform knife edge wear.

Figure 3B:
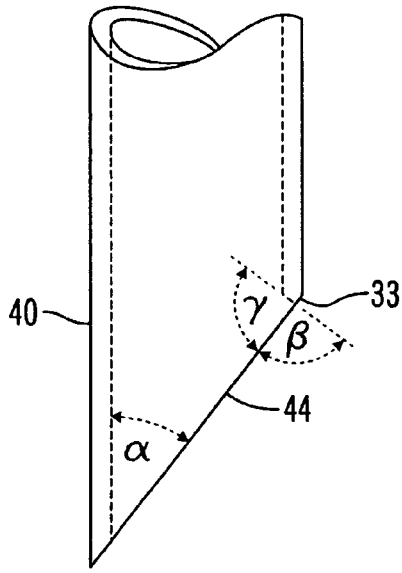
FIG. 3B is a side plan view of the hollow tufting needle of FIG. 3A.

Additional details of the configuration of the most preferred knife edge 39 and cutting surface 44 and cutting edge 33 of the hollow needle 40 may be described in connection with FIGS. 3A and 3B. Specifically, the knife edge 39 is not normal to the sides of the knife 47 but instead is sharpened at a slant of approximately 6 degrees. The angled cutting surface 44 is at angle $\alpha$ from the edges of hollow needle 40 and $\alpha$ is preferably about 22 degrees. The cutting edge 33 is formed by the cutting surface 44 and an inward surface formed an angle of approximately 100 degrees, represented by angle $\gamma$ from the angled cutting surface 44. The 80 degree supplementary angle is represented by $\beta$ in FIG. 3B.

Figure 4:
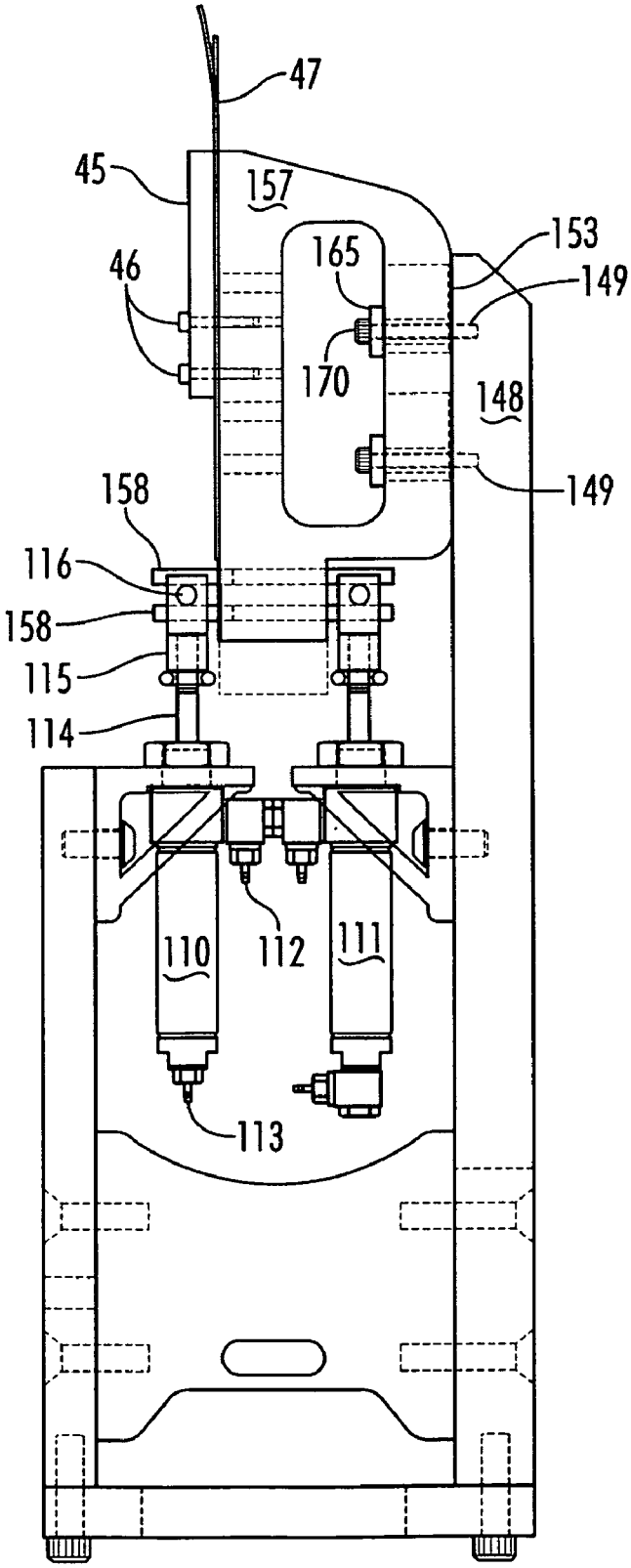
FIG. 4 is a side plan view showing a knife assembly wherein a knife may be selectively operated pneumatically to produce cut and looped tufts of yarn with an alternative sliding embodiment.

FIG. 4 shows an alternative sliding assembly designed for selected operation of knives 47 into contact with cutting surfaces 44 of associated hollow needles 40. This movement may be imparted pneumatically with mounting brackets 157 that have been loosely received into knife support bar 148. As in the previously described embodiment, knives 47 are attached to brackets 157 with clamping blocks 45 and mounting pins 46. However, extending laterally through the front side of sliding brackets 157 are a pair of vertically oriented longitudinal slots 153. A fastener 170 is placed through a T-shaped bushing 165 and secured in the knife support bar 148 so that the fastener bottoms out in opening 149 of knife support bar 148 before tightly clamping the flange 166 of bushing 165 against the sliding bracket 157. The slots 153 are also designed with a greater width than the diameter of the stem 167 of bushings 165. In this fashion, the brackets are moveable vertically in slots 153. Optionally there may be provided sufficient lateral play to allow the brackets to move about one degree from left to right, thereby permitting precise alignment of knife edge 39 with the angled cutting surface 44. However, the presently preferred method of obtaining precise alignment is to use the swivel brackets of FIG. 2, and the mounting bracket 55 of that design may be modified through the addition of slots to permit the brackets to be slideably mounted and operate to only selectively cut yarns.

Figure 5B:
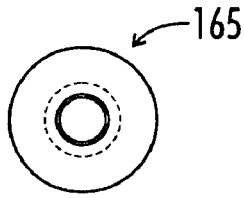
FIG. 5B is a back plan view of the bushing of FIG. 5A.
Figure 5A:
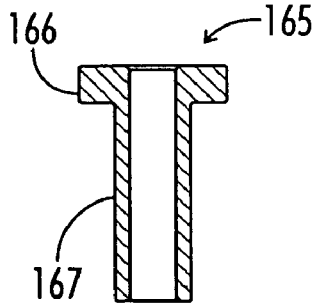
FIG. 5A is a sectional plan view of a bushing of the type used in attaching the sliding brackets to the knife block support in FIG. 4.
Figure 6D:
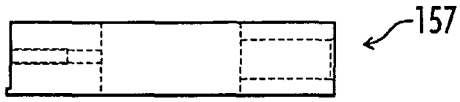
FIG. 6D is a top plan view of the sliding bracket of FIG. 6A.
Figure 6A:
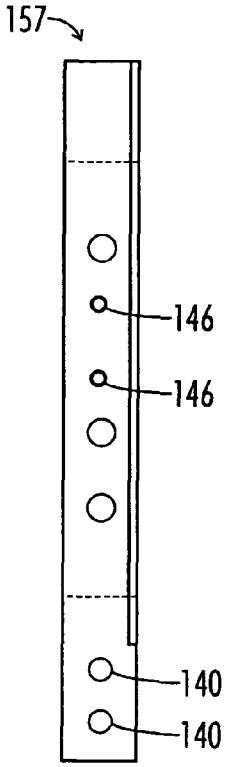
FIG. 6A is a back plan view of a sliding bracket of the type shown in FIG. 4.
Figure 6B:
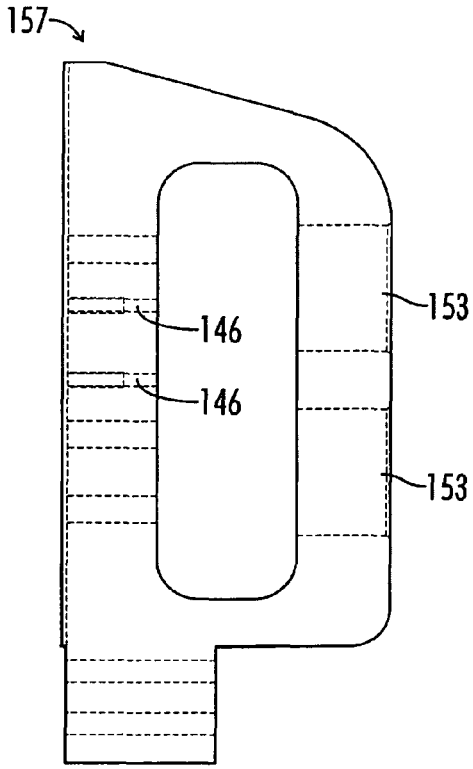
FIG. 6B is a side plan view of the sliding bracket of FIG. 6A.
Figure 6C:
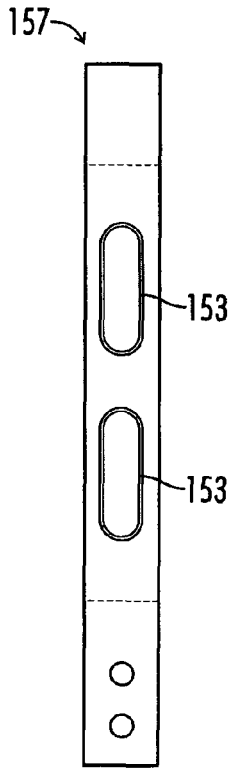
FIG. 6C is a front plan view of the sliding bracket of FIG. 6A.

The sliding brackets 157 of FIG. 4 are shown in detail in FIGS. 6A through 6D and the bushings 165 are shown in FIGS. 5A and 5B. These sliding brackets 157 and bushings 165 may be used in a cut pile tufting machine by simply fixing the vertical height of the brackets 157, as by securing an angle iron laterally beneath the brackets when positioned in their upwardly oriented positions as shown in FIG. 4. Of greater interest is the use of the sliding brackets 157 in a cut/loop tufting machine, where the sliding brackets are selectively actuated to upwardly oriented positions to produce cut pile bights of yarn and retracted to downwardly oriented positions where the associated knives 47 will not cross the cutting surfaces 44 of associated hollow needles to produce loop pile bights of yarn.

Figure 7:
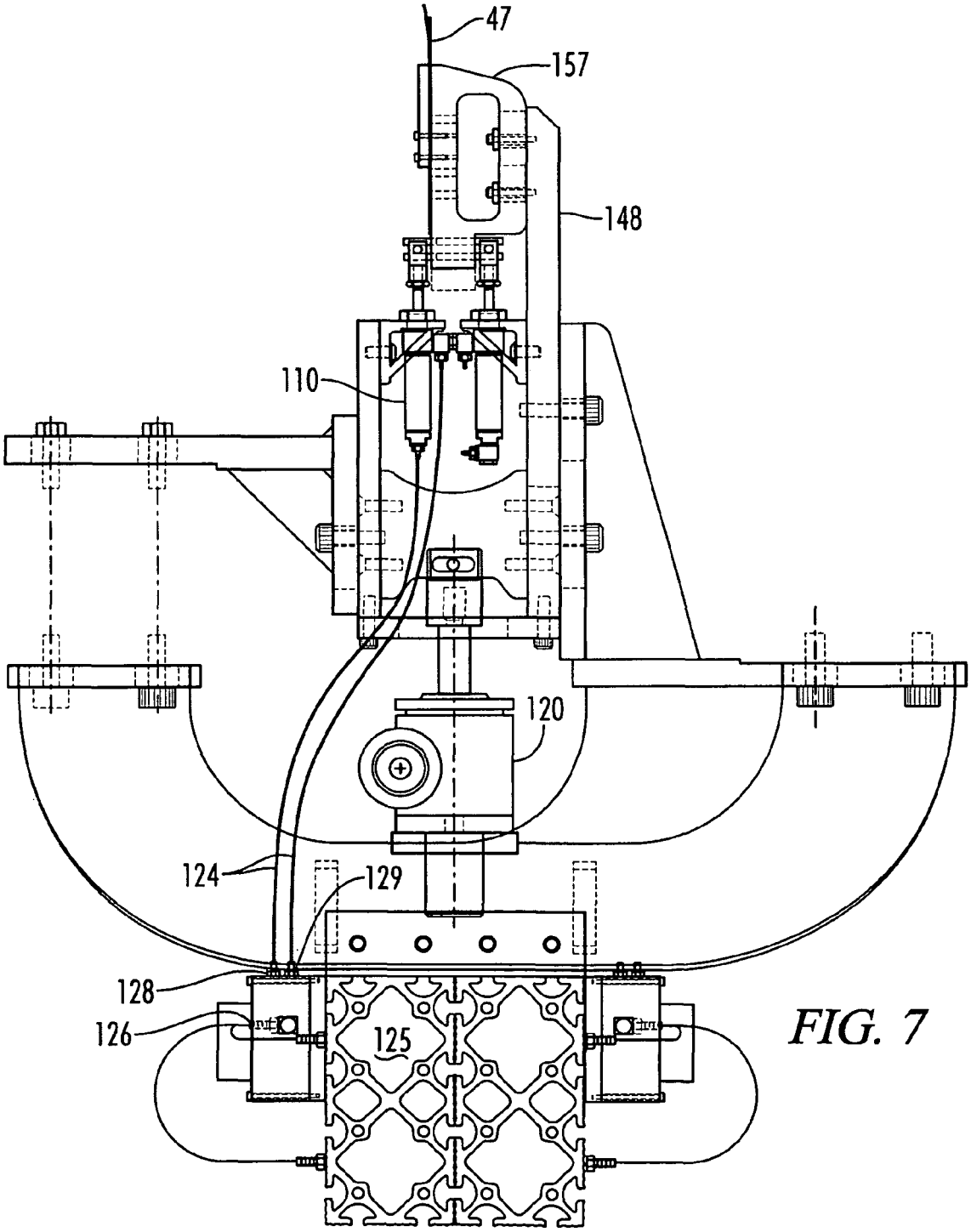
FIG. 7 is a sectional view of the knife assembly of FIG. 4 showing the height adjustment and pneumatic supply.

A representative actuating system is shown in FIGS. 4 and 7 with coupling pins 158 extending from openings 140 in the base of sliding bracket 157. Since openings 140 extend through the base, coupling pins may be mounted with alternating rearward and forward orientations to allow more space for actuators such as double acting pneumatic cylinders 110, 111. Cylinder 110 is shown with piston 114 carrying clevis 115 and clevis pin 116. Application of air pressure to upper port 112 causes the piston 114 to retract and associated clevis pin 116 to urge lower coupling pin 158 downward, thereby moving the associated knife 47 out of cutting position resulting in a loop pile yarn bight. Similarly, application of air pressure to lower port 113 causes the piston 114 to extend and associated clevis pin 116 to urge upper coupling pin 158 upward, thereby moving the associated knife 47 into cutting position resulting in a cut pile yarn bight.

FIG. 7 illustrates air supply manifolds 125 supplying pressurized air or gas by ports 126 to electronically controlled valves 128, 129 that supply pressure by hoses 124 to ports 112, 113. All of the control signals for the valves may be supplied by signals over an appropriate controller network from an electronic controller interpreting pattern data. The overall height of the cutting mechanism can also be adjusted by height control mechanism 120, preferably servo motor driven and indexed for precise height control. Adjusting the height of the cutting mechanism alters the height of the resulting cut pile tufts and the loop pile tufts supplied at the same yarn feed rates. However, it will be appreciated that yarns for loop pile tufts are not cut at the uniform height of the intersection of the knives 47 with hollow needle cutting surfaces 44 and therefore yarns that are only to be tufted as loop pile bights may be fed at different rates. Therefore it is possible to create fabrics with cut pile bights and loop pile bights at heights resulting from yarn fed at a first feed rate, and with loop pile bights at one or more different heights resulting from yarns fed at second, and optionally third, yarn feed rates.

Furthermore, while in traditional operation with one of six yarns being fed selectively to a single hollow needle 40 for each stitch, the tufting machine may be efficiently operated by shifting laterally to make stitches only for about a half inch before advancing to the next row of stitches, it is also possible to have only one of twelve yarns be fed to one of two hollow needles for each stitch while the tufting machine in operated by shifting laterally to make stitches for about one full inch before advancing to the next row of stitches. Similarly, if only a single yarn of eighteen yarns available to three adjacent needles is selected for a single stitch while the tufting machine is operated laterally for about one and a half inches before advancing to the next row of stitches, or so that only a single yarn of twenty-four yarns available to four needles is fed for each stitch while the fabric is shifted laterally for about two inches before being advanced, the tufting operation will be slowed, however, the number of colors available in the tufting palette is greatly increased. If eight yarns, instead of six, were provided to each needle, the number of possible different yarns would increase from 6, 12, 18 and 24 to 8, 16, 24 and 32, providing an incredible variety of colors and textures that surpasses even the variety available in most weaving techniques. In this operation of increased lateral shifting, it is also possible to tuft more than a single yarn on a stitch to provide areas of increased yarn and stitch density in the pattern. Increased lateral shifting may also be combined with varied loop pile height stitches for greater pattern diversity.

All publications, patent, and patent documents mentioned herein are incorporated by reference herein as though individually incorporated by reference. Although preferred embodiments of the present invention have been disclosed in detail herein, it will be understood that various substitutions and modifications may be made to the disclosed embodiment described herein without departing from the scope and spirit of the present invention as recited in the appended claims.

We claim:

1. In a tufting machine having a yarn feed supplying a plurality of yarns to each of a plurality of reciprocating laterally spaced hollow needles having heads and opposed angled ends, wherein a selected one of the plurality of yarns if fed into the head of a hollow needle and tufted by reciprocal movement of the needle through a backing fabric fed from front to back over a backing support, the selected yarn exiting an opening at the angled end of the hollow needle to leave a yarn bights in the backing fabric, an improved yarn cutting apparatus wherein the angled ends of the spaced hollow needles have distal tips and angled cutting surfaces proceeding rearward about the openings to proximate notches with cutting edges and hollows formed at the rear of the angled cutting surfaces.

2. The improved cutting apparatus of claim 1 wherein for cooperation with each of the plurality of angled cutting surfaces, a knife is fixed to a bracket, and the bracket is connected to a knife bar so that the knife may pivot with respect to the knife bar.

3. The improved cutting apparatus of claim 1 wherein for cooperation with each of the plurality of angled cutting surfaces, a knife is fixed to a bracket, and the bracket is slideably connected to a knife bar so that the knife may be selectively moved into or out of contact with the angled cutting surface during the reciprocal movement of the needle through the backing fabric.

4. The improved cutting apparatus of claim 2 wherein the knife is affixed to a forward bracket having a rearwardly extending arm pivotally connected to a rear bracket mounted on the knife bar.

5. The improved cutting apparatus of claim 4 wherein the forward bracket and the rear bracket are pivotally connected by a pin extending through an opening in the rearwardly extending arm and an opening in the rear bracket.

6. The improved cutting apparatus of claim 3 wherein the bracket is selectively moved through the actuation of a double acting pneumatic cylinder in communication with the bracket.

7. The improved cutting apparatus of claim 3 wherein the bracket is mounted to the knife bar with a fastener and bushing assembly positioned within a longitudinal slot of the bracket.

8. In a tufting machine having a yarn feed supplying a plurality of yarns to each of a plurality of reciprocating laterally spaced hollow needles having heads and opposed angled ends, wherein a selected one of the plurality of yarns if fed into the head of a hollow needle and tufted by reciprocal movement of the needle through a backing fabric fed from front to back over a backing support, the selected yarn exiting an opening at the angled end of the hollow needle to leave a yarn bights in the backing fabric, an improved yarn cutting apparatus wherein for cooperation with each of the plurality of angled cutting surfaces, a knife is fixed to a bracket, and the bracket is connected to a knife bar so that the knife may pivot with respect to the knife bar.

9. The improved cutting apparatus of claim 8 wherein the angled ends of the spaced hollow needles have distal tips and angled cutting surfaces proceeding rearward about the openings to proximate notches with cutting edges and hollows formed at the rear of the angled cutting surfaces.

10. The improved cutting apparatus of claim 8 wherein the bracket comprises a forward bracket portion and a rear bracket portion and knife is affixed to the forward bracket portion which has a rearwardly extending arm pivotally connected to the rear bracket portion, and the rear bracket portion is mounted on the knife bar.

11. The improved cutting apparatus of claim 10 wherein the forward bracket portion and the rear bracket portion are pivotally connected by a pin extending through an opening in the rearwardly extending arm and an opening in the rear bracket portion.

12. The improved cutting apparatus of claim 8 wherein for cooperation with each of the plurality of angled cutting surfaces, a knife is fixed to a bracket, and the bracket is slideably connected to a knife bar so that the knife may be selectively moved into or out of contact with the angled cutting surface during the reciprocal movement of the needle through the backing fabric.

13. The improved cutting apparatus of claim 12 wherein the bracket is selectively moved through the actuation of a double acting pneumatic cylinder in communication with the bracket.

14. The improved cutting apparatus of claim 12 wherein the bracket is mounted to the knife bar for slideable movement with a fastener and bushing assembly positioned within a longitudinal slot of the bracket.

15. In a tufting machine having a yarn feed supplying a plurality of yarns to each of a plurality of reciprocating laterally spaced hollow needles having heads and opposed angled ends, wherein a selected one of the plurality of yarns if fed into the head of a hollow needle and tufted by reciprocal movement of the needle through a backing fabric fed from front to back over a backing support, the selected yarn existing exiting an opening at the angled end of the hollow needle to leave a yarn bights in the backing fabric, an improved yarn cutting apparatus wherein for cooperation with each of the plurality of angled cutting surfaces, a knife is fixed to a bracket, and the bracket is mounted to a knife bar for slideable movement with a fastener and bushing assembly positioned within a longitudinal slot of the bracket, so that the knife may be selectively moved into or out of contact with the angled cutting surface during the reciprocal movement of the needle through the backing fabric.

16. The improved cutting apparatus of claim 15 wherein the angled ends of the spaced hollow needles have distal tips and angled cutting surfaces proceeding rearward about the openings to proximate notches with cutting edges and hollows formed at the rear of the angled cutting surfaces.

17. The improved cutting apparatus of claim 15 wherein the bracket is selectively moved through the actuation of a double acting pneumatic cylinder in communication with the bracket.

18. The improved cutting apparatus of claim 15 wherein the bracket comprises a forward bracket portion and a rear bracket portion and knife is affixed to the forward bracket portion which has a rearwardly extending arm pivotally connected to the rear bracket portion, and the rear bracket portion is mounted on the knife bar.

19. The improved cutting apparatus of claim 18 wherein the forward bracket portion and the rear bracket portion are pivotally connected by a pin extending through an opening in the rearwardly extending arm and an opening in the rear bracket portion.

20. The improved cutting apparatus of claim 19 wherein the angled ends of the spaced hollow needles have distal tips and angled cutting surfaces proceeding rearward about the openings to proximate notches with cutting edges and hollows formed at the rear of the angled cutting surfaces.

* * * * *